US008910791B2

(12) United States Patent
Zhao

(10) Patent No.: US 8,910,791 B2
(45) Date of Patent: Dec. 16, 2014

(54) SLOT-TYPE PROTECTION DEVICE FOR PLATE-SHAPED PRODUCT

(71) Applicant: Shenzhen China Star Optoelectronics Technology Co., Ltd., Shenzhen, Guangdong (CN)

(72) Inventor: Zhilin Zhao, Shenzhen (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 80 days.

(21) Appl. No.: 13/812,150

(22) PCT Filed: Jan. 5, 2013

(86) PCT No.: PCT/CN2013/070084

§ 371 (c)(1),
(2), (4) Date: Jan. 25, 2013

(87) PCT Pub. No.: WO2014/101308

PCT Pub. Date: Jul. 3, 2014

(65) Prior Publication Data

US 2014/0183083 A1 Jul. 3, 2014

(30) Foreign Application Priority Data

Dec. 28, 2012 (CN) ..... 2012 1 0584796

(51) Int. Cl.

| | |
|---|---|
| ***B65D 81/02*** | (2006.01) |
| ***B65D 25/10*** | (2006.01) |
| ***B65D 81/113*** | (2006.01) |
| ***B65D 85/48*** | (2006.01) |

(52) U.S. Cl.

CPC ..... *B65D 81/022* (2013.01); *B65D 25/107* (2013.01); *B65D 81/113* (2013.01); *B65D 85/48* (2013.01)

USPC ..... 206/523; 206/454; 206/587

(58) Field of Classification Search

USPC ..... 206/523, 454, 587, 521, 449, 455, 591, 206/592, 594, 588

See application file for complete search history.

(56) References Cited

U.S. PATENT DOCUMENTS

| | | | | |
|---|---|---|---|---|
| 8,251,220 | B2 * | 8/2012 | Ting et al. | 206/587 |
| 8,720,691 | B2 * | 5/2014 | Hu | 206/587 |
| 2007/0125677 | A1 * | 6/2007 | Oronsky et al. | 206/446 |
| 2011/0056868 | A1 * | 3/2011 | Ting et al. | 206/587 |
| 2012/0211398 | A1 * | 8/2012 | Hu | 206/725 |

FOREIGN PATENT DOCUMENTS

| | | | |
|---|---|---|---|
| CN | 201228135 | Y | 4/2009 |
| CN | 102700851 | A | 10/2012 |

* cited by examiner

*Primary Examiner* — Andrew Perreault
(74) *Attorney, Agent, or Firm* — Andrew C. Cheng

(57) ABSTRACT

A slot-type protection device for a plate-shaped product is disclosed. The device comprises a buffer component for inserting the plate-shaped product. The buffer component comprises a folding card and at least one buffer unit. A plurality of slots used for fixing the plate-shaped product are disposed on the buffer unit. The buffer unit comprises a carrying portion and a connecting portion. The slots are disposed on the carrying portion. Two ends of the connecting portion are a fixed end and a free end. The fixed end is fixed and connected to one end of a bottom of the carrying portion, and the free end cooperates with the other end of the bottom of the carrying portion. A connecting structure is disposed to allow the free end and the carrying portion to connect with each other. The folding card is held between the carrying portion and the connecting portion.

7 Claims, 2 Drawing Sheets

SLOT-TYPE PROTECTION DEVICE FOR PLATE-SHAPED PRODUCT

BACKGROUND OF THE INVENTION

1. Field of the Invention

The present invention relates to a packing field, more particularly, to a slot-type protection device for plate-shaped products.

2. Description of the Related Art

In the now existing technology, liquid crystal displays, edge-lit LED backlight modules, glass substrates for liquid crystal displays, and other type of flat-panel display device do not have a big ratio of length to width. However, the ratio of length to thickness and the ratio of width to thickness of them are big. Namely, their thin plate-like shape makes them difficult to be packaged for transportation.

When these plate-like products or semi-products are transported, the industry usually collects them and packages them into a box. There must be slots in the box for spacing apart and protecting each of the products. Under the circumstances, the packaging device is generally constituted by an outer box and an inner buffer component. A plurality of slots used for fixing liquid crystal products is disposed on the buffer component. The slots are not only used for fixing the plate-shaped product but also used for providing buffer and protection to the plate-shaped product. There are a plurality of solutions for packing and protecting the plate-shaped products adapted by the industry. EPS is not environment friendly. Paper card solution is complex. The most common solution is EPE buffer component. In patent document 1 (Publication Number CN 102700851A), a packaging device for packing the flat panel liquid crystal product is disclosed. However, the fact that the buffer materials held together by binding makes them difficult to be recycled, replaced, and cleaned. Moreover, the whole buffer component needs to be scrapped if there is any defect on it. The material consumption is considerable. In addition, the price for material is more expensive, which is disadvantageous to packing cost reduction.

SUMMARY OF THE INVENTION

The present invention provides a slot-type protection device for a plate-shaped product to allow the buffer unit be fixed by itself and ready to be recycled, replaced, and cleaned.

The present invention provides a slot-type protection device for a plate-shaped product. The slot-type protection device for the plate-shaped product comprises a buffer component for inserting the plate-shaped product. The buffer component comprises a folding card and at least one buffer unit. A plurality of slots used for fixing the plate-shaped product is disposed on the buffer unit. The buffer unit comprises a carrying portion and a connecting portion. The slots are disposed on the carrying portion. Two ends of the connecting portion are a fixed end and a free end. The fixed end is fixed and connected to one end of a bottom of the carrying portion, and the free end cooperates with the other end of the bottom of the carrying portion. A connecting structure is disposed to allow the free end and the carrying portion to connect with each other. The folding card is held between the carrying portion and the connecting portion. The buffer unit can be attached to the folding card randomly so that the assembly and replacement can be very convenient.

Preferably, the connecting structure comprises a hook extending inward disposed at the free end of the connecting portion and a first recess disposed in the carrying portion.

Preferably, the hook is an integrated part of the free end of the connecting portion, the hook comprises a supporting portion extending upward and a block projecting inward on the supporting portion, the first recess in the carrying portion is corresponding to the block.

Preferably, the connecting structure is a Velcro.

Preferably, a recess is located between the carrying portion and the connecting portion, and the folding card is inserted in the recess.

Preferably, a plurality of openings is symmetrically disposed on opposite sides of the folding card and spaced apart from each other, the buffer unit is connected to the openings of the folding card, a width between the openings of the folding card is the same as a width of the recess.

Preferably, a width of the folding card is the same as a width of the buffer unit.

Preferably, the buffer unit is made of EPP foam material or EPE foam material, and the folding card is made of corrugated board or hollowed plate-shaped PP material.

The present invention makes improvements to the current protection device. In contrast to the prior art, the buffer unit of the present invention can be detachably fixed to the folding card. If there is damage to any part of the buffer unit or the folding card, the damaged part can be directly replaced without scrapping the whole set of buffer component. Therefore, the material consumption is reduced to reduce the material cost. Furthermore, the buffer unit can be detached during storage and transportation and the separate parts can be put in a stack to closely contact each other. Thirty percent of the warehouse space and the transportation space are saved when compared with the conventional fixing method by binding. As a result, less space is occupied by the buffer unit during storage and transportation to increase the space utilization rate. The warehouse cost and the transportation cost are thus reduced.

DESCRIPTION OF THE EMBODIMENTS

In order to illustrate the technique and effects of the present invention, a detailed description will be disclosed by the following disclosure in conjunction with figures. Please note that, the same components are labeled by the same number.

Embodiment 1

Figure 1:
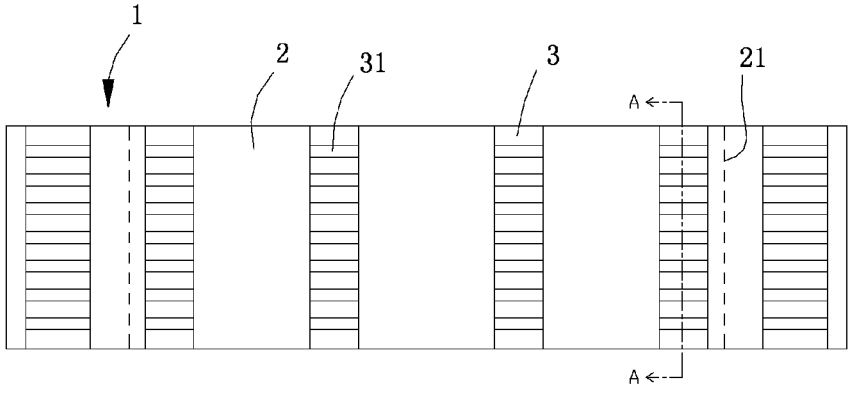
FIG. 1 is a schematic diagram showing a structure of a buffer component according to embodiment 1 of the present invention.
Figure 2:
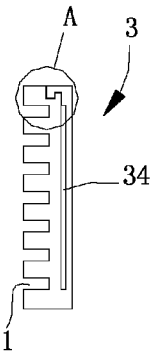
FIG. 2 is a cross sectional view taken along line A-A of FIG. 1.

The plate-shaped product may be a liquid crystal display or an edge-lit LED backlight modules according to the present invention. As shown in FIG. 1, a buffer component 1 of a slot-type protection device for a plate-shaped product according to the embodiment comprises a folding card 2 and at least one buffer unit 3 fixed on the folding card 2. A plurality of slots 31 used for fixing the plate-shaped products is disposed on the buffer unit 3. The folding card 2 is mainly used for resisting external impact and connecting each of the buffer units 3. The buffer unit 3 is mainly used for fixing the plate-shaped products and providing buffer and protection to them. As shown in figures, the plurality of buffer units 3 disposed on the folding card 2 are in parallel with and spaced apart from each other. A plurality of folding lines 21 in parallel with the buffer units 3 is disposed on the folding card 2 so that two ends of the folding card 2 are allowed to be folded upward to hold the plate-shaped products from triple planes. In the following, the folding card 2 and the buffer component 3 are illustrated in detail in consideration of the other accompanying drawings.

Figure 3:
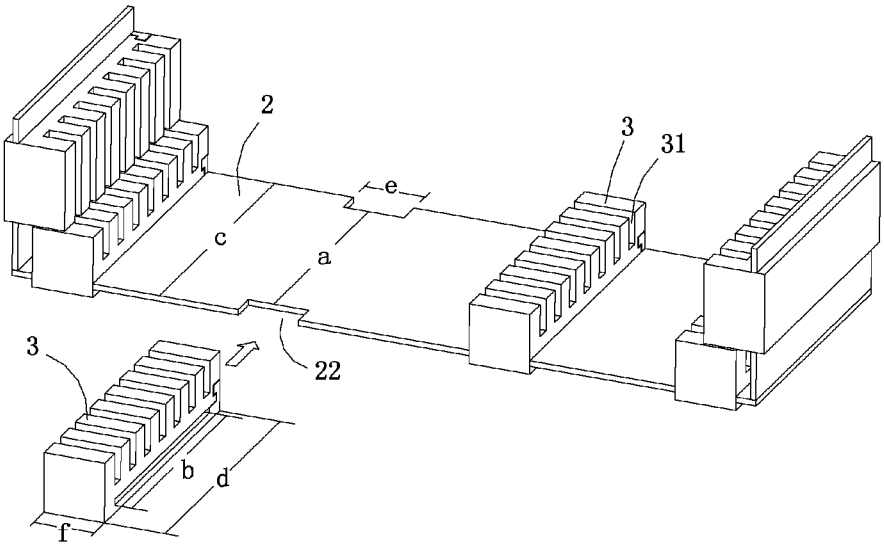
FIG. 3 is an exploded view of the structure of the buffer component according to embodiment 1 of the present invention.
Figure 4:
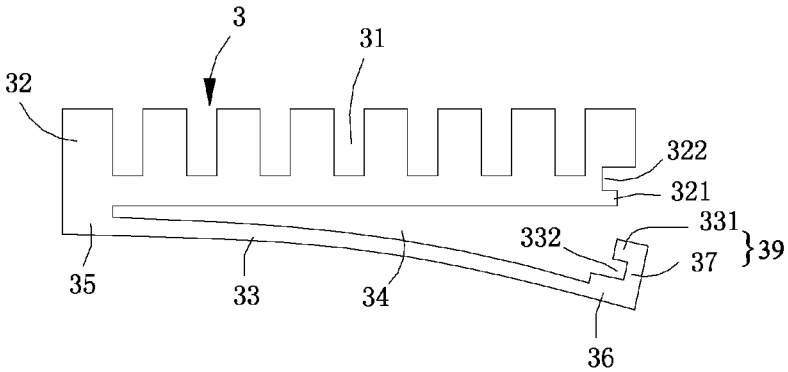
FIG. 4 is a schematic diagram showing a structure of a buffer unit according to embodiment 1 of the present invention.
Figure 5:
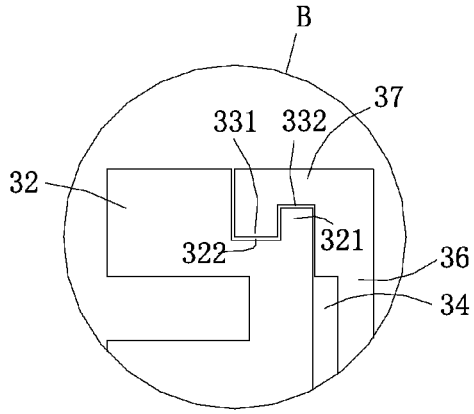
FIG. 5 is a partial enlarged view of B in FIG. 1.

Please also refer to FIG. 3 to FIG. 5, the buffer unit 3 is constituted by a carrying portion 32 and a connecting portion 33 which are respectively an upper portion and a lower portion of the buffer unit 3. A design of the slots is the same as the current one. The slots 31 are disposed on the carrying portion 32. Two ends of the connecting portion 33 are a fixed end 35 and a free end 36. The fixed end 35 is fixed and connected to one end of a bottom of the carrying portion 35, and the free end 36 cooperates with the other end of the bottom of the carrying portion 35. A connecting structure is disposed to allow the free end 36 and the carrying portion 35 to connect with each other. The folding card 2 is held between the carrying portion 32 and the connecting portion 33. As shown in the figures, the connecting structure according to the present embodiment comprises a hook 39 extending inward disposed at the free end of the connecting portion and a first recess 322 disposed in the carrying portion. The hook 39, being an integrated part of the free end 36 of the connecting portion, comprises a supporting portion 37 extending upward and a block 331 projecting inward on the supporting portion. A second recess 332 is thus formed underneath the block 331. The first recess 322 is corresponding to the block 311. At the same time, a block 321 is formed in the carrying portion 32 and corresponds to the second recess 332. When the free end of the connecting portion is connected to the carrying portion 32, the block 321 is tightly engaged with the second recess 332 and the block 331 is tightly engaged with the first recess 322 so that the buffer unit 3 is assembled into an integrated part. As also shown in the figures, the buffer unit 3 as assembled into an integrated part comprises a recess 34, namely the recess 34 located between the carrying portion 32 and the connecting portion 33, which is used for positioning the folding card 2. A plurality of openings 22 is symmetrically disposed on opposite sides of the folding card and spaced apart from each other. The buffer unit 33 is fixedly mounted to the openings 22. In order to secure the connection and ensure that there is not any movement, a width a between the openings 22 of the folding card 2 is the same as a width b of the recess 34. A width c in other portion of the folding card 2 is the same as a width d of the buffer unit 3. Hence, the whole buffer component 1 has a unified dimensional specification. Not only does it have a handsome appearance, but also it is easily attached and detached.

When mounting, the free end of the connecting portion 33 of the buffer unit is first detached from the carrying portion 32, and a portion of the folding card 2 between the openings 2 is engaged into the recess 34 of the buffer unit. It is understandable that a better effect is achieved when a length e of the opening 22 is the same as a thickness f of the buffer unit. Then the block 331 of the connecting portion is engaged with the first recess 322 of the carrying portion. The fixed connection between the buffer unit 3 and the folding card 2 is thus achieved. Other buffer units 3 are also connected to the folding card 2 in the same manner. The two ends of the folding card 2 may, based on the packing requirements, be folded upward along the folding lines 21 to form the buffer component 1 having a triple-plane supporting effect. The plate-shaped product can be inserted in slots 31 of a plurality of buffer units on a same plane. According to the present invention, the buffer unit 3 is made of expanded poly-propylene (EPP) foam material, and the folding card 2 is made of corrugated board. Similarly, the buffer unit 3 may be made of expanded poly-ethylene (EPE) material, and the folding card 2 may be made of hollowed plate-shaped (PP) material. A hardness of the buffer unit 3 is lower than that of the folding card 2 so the folding card 2 is allowed to be squeezed into the space between the carrying portion 32 and the connecting portion 33 of the buffer unit.

Embodiment 2

Figure 6:
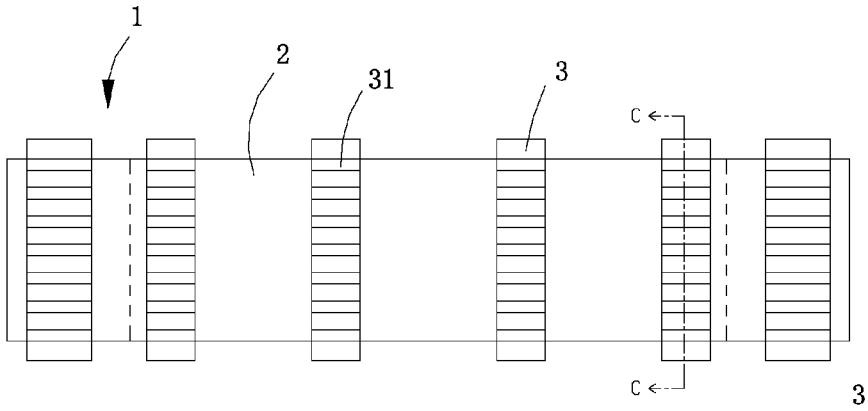
FIG. 6 is a schematic diagram showing a structure of a buffer component according to embodiment 2 of the present invention.
Figure 7:
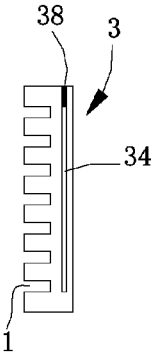
FIG. 7 is a cross sectional view taken along line C-C of FIG. 6.
Figure 8:
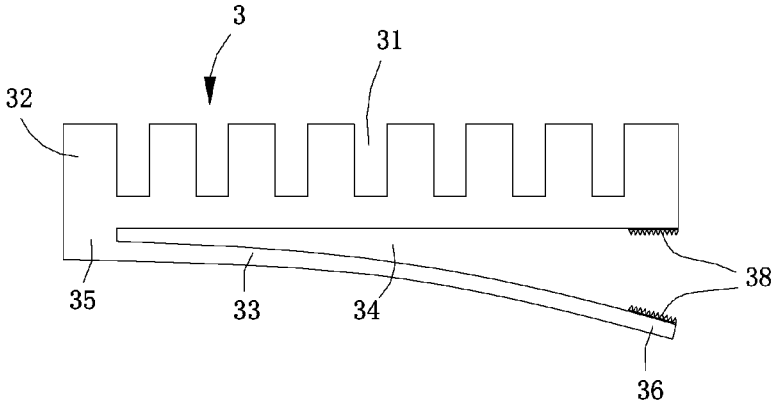
FIG. 8 is a schematic diagram showing a structure of a buffer unit according to embodiment 2 of the present invention.

Please refer to FIG. 6 to FIG. 8, different from the previous embodiment, the connecting structure used for connecting the free end 36 of the connecting portion 33 to a bottom of the carrying portion 32 is a Velcro according to the present embodiment. That means, there are Velcro fastening straps 38 fixed on both the free end 36 of the connecting portion 33 and the corresponding portion of the carrying portion 32. The installer only needs to tear them away a little harder before their attachment is released. Therefore, it's more convenient and speedy. Since the buffer unit 3 is made of a foaming material, it has a certain degree of flexibility. As a result, a height of the recess 34 and a thickness of folding card 2 don't need to be very accurate. Furthermore, the present embodiment differs from the previous embodiment in that there is no opening 22 disposed on the folding card 2. Hence, the folding card 2 has a unified width. The buffer unit 3 can be disposed in any position, which makes the operation flexible and easy.

According to the embodiments of the present invention, if there is damage to any part of the buffer unit or the folding card, the damaged part can be directly replaced without scrapping the whole set of buffer component. Therefore, it is convenient for material recycling. It also reduces the scrap rate to achieve the objective of cost reduction.

According to the embodiments of the present invention, the buffer unit 3 can be detached from the folding card 2 so they become separate parts during storage and transportation. They can also be put in a stack to closely contact each other. When compared with the conventional fixing method in which a binding process is performed to form the buffer component and two buffer components lock each other and stack, the present invention method will greatly save space. As a result, the warehouse cost and the transportation cost are reduced. The present embodiment is a simpler embodiment of the present invention slot-type protection device for the plate-shaped product that is advantageous to the saving of warehouse space and transportation space.

In summary, when compared with the current fixing method by binding, the present invention method provides the buffer units 3 being able to be fixed by itself. There is no necessity to binding the buffer materials so as to form the protection device for the plate-shaped product. If there is damage to any part, the damaged part can be directly replaced without scrapping the whole set of buffer component. Hence, it is convenient for material recycling. Furthermore, the buffer unit can be detached during storage and transportation and the separate parts can be put in a stack to closely contact each other. Thirty percent of the warehouse space and the transportation space are saved to increase the space utilization rate.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slot-type protection device for a plate-shaped product, comprising a buffer component for inserting the plate-shaped product, the buffer component comprising a folding card and at least one buffer unit, a plurality of slots used for fixing the plate-shaped product being disposed on the buffer unit;

wherein the buffer unit comprises a carrying portion and a connecting portion, the slots are disposed on the carrying portion, two ends of the connecting portion are a fixed end and a free end, the fixed end is fixed and connected to one end of a bottom of the carrying portion, and the free end cooperates with the other end of the bottom of the carrying portion, wherein the one end of the bottom of the carrying portion is on an opposite side of the other end of the bottom of the carrying portion a connecting structure is disposed to allow the free end and the carrying portion to connect with each other, the folding card is held between the carrying portion and the connecting portion, wherein the connecting structure comprises a hook extending inward disposed at the free end of the connecting portion and a first recess disposed in the other end of the bottom of the carrying portion and the fixed end is on an opposite side to the hook, the free end, and the first recess.

2. The slot-type protection device for the plate-shaped product as claimed in claim 1, wherein the hook is an integrated part of the free end of the connecting portion, the hook comprises a supporting portion extending upward and a block projecting inward on the supporting portion, the first recess in the carrying portion is corresponding to the block.

3. The slot-type protection device for the plate-shaped product as claimed in claim 1, wherein a recess is located between the carrying portion and the connecting portion, and the folding card is inserted in the recess.

4. The slot-type protection device for the plate-shaped product as claimed in claim 2, wherein a recess is located between the carrying portion and the connecting portion, and the folding card is inserted in the recess.

5. The slot-type protection device for the plate-shaped product as claimed in claim 4, wherein a plurality of openings is symmetrically disposed on opposite sides of the folding card and spaced apart from each other, the buffer unit is connected to the openings of the folding card, a width between the openings of the folding card is the same as a width of the recess.

6. The slot-type protection device for the plate-shaped product as claimed in claim 5, wherein a width of the folding card is the same as a width of the buffer unit.

7. The slot-type protection device for the plate-shaped product as claimed in claim 2, wherein the buffer unit is made of expanded poly-propylene (EPP) foam material or expanded poly-ethylene (EPE) foam material, and the folding card is made of corrugated board or hollowed plate-shaped poly-propylene (PP) material.

* * * * *